United States Patent [19]

Krasznai

[11] Patent Number: 4,968,174

[45] Date of Patent: Nov. 6, 1990

[54] LATCH FOR TELESCOPING HANDLE OF VACUUM CLEANER

[75] Inventor: Charles Z. Krasznai, Trumbull, Conn.

[73] Assignee: Black & Decker, Inc., Newark, Del.

[21] Appl. No.: 218,692

[22] Filed: Jul. 13, 1988

[51] Int. Cl.[5] ..... B25G 3/18

[52] U.S. Cl. ..... 403/327; 403/329; 403/330; 285/320

[58] Field of Search ..... 403/329, 330, 327, 325, 403/108, 109; 285/7, 319, 320

[56] References Cited

U.S. PATENT DOCUMENTS

| | | | |
|---|---|---|---|
| 2,712,151 | 7/1955 | Becht | 403/325 X |
| 3,245,698 | 4/1966 | Fromknecht | 285/319 X |
| 3,602,009 | 8/1971 | Powell | 285/319 X |
| 3,713,076 | 1/1973 | Gabrielian et al. | 403/327 X |
| 4,669,755 | 6/1987 | Harris et al. | 285/320 X |
| 4,798,098 | 1/1989 | Keller et al. | 403/330 X |

*Primary Examiner*—Andrew V. Kundrat

*Attorney, Agent, or Firm*—Barry E. Deutsch

[57] ABSTRACT

A molded resin integral spring in a latch member is backed up by a prestressed metal flat spring. The flat spring is retained in the latch member by a boss molded into a cavity in a latch button and by a slot in a cantilevered member. The resilient springback of the flat spring backs up the resilience of the integral spring to provide long-term positive latching.

2 Claims, 8 Drawing Sheets

LATCH FOR TELESCOPING HANDLE OF VACUUM CLEANER

BACKGROUND OF THE INVENTION

The present invention relates to housewares and, more particularly to vacuum cleaners.

Vacuum cleaners are almost indispensable houseware appliances for household cleaning. Such cleaners are most commonly powered by AC power from an external source. Generally, they consist of a fan or blower operative to produce a partial vacuum at an intake. Air sucked in by the partial vacuum passes through a filter bag whereby dirt particles are removed from the air stream. The filtered air is returned to the environment.

The above externally powered vacuum cleaners tend to be large and heavy. Thus, certain types of cleaning which is adapted to vacuum cleaning is not conveniently performed with them. In addition, the need for an external power source limits their use to areas where such external power sources are available.

A relatively new class of vacuum cleaner solves the problems of size, weight and power availability. Such a new class, disclosed in U.S. Pat. No. 4,209,875, the disclosure of which is incorporated herein by reference, is exemplified by a cordless, hand-held, vacuum cleaner sold under the trademark Dust Buster by the Black and Decker Corporation. The cordless condition is achieved by an internal rechargeable battery in the vacuum cleaner capable of being recharged between uses.

Hand-held vacuum cleaners cannot be used on certain surfaces such as, for example, floors without requiring the user to stoop over. Consequently, a vacuum cleaner adapted for cleaning a floor without stooping appears to extend the advantages of cordless vacuuming.

A cordless vacuum cleaner is disclosed in U.S. patent application Ser. No. 35,072 of a type having a swivelling floor tool and a telescoping handle. The telescoping handle is retained in position by a resin integral spring in a molded resin latch. It has been discovered that the integral spring tends to take a permanent set over time, thus interfering with its ability to urge its locking dogs into a latching position.

OBJECTS AND SUMMARY OF THE INVENTION

It is an object of the invention to provide a latch for a telescoping handle of a vacuum cleaner which overcomes the drawbacks of the prior art.

It is a further object of the invention to provide a latch for a telescoping handle of a vacuum cleaner wherein an integral hinge of a latch member is backed up by a metallic resilient spring.

It is a further object of the invention to provide a latch for a telescoping handle for a vacuum cleaner wherein a resilient preset of flat spring provides a substantially fatigue-free resilient backup for an integral hinge in a resin latch member.

Briefly stated, the present invention provides a molded resin integral spring in a latch member backed up by a prestressed metal flat spring. The flat spring is retained in the latch member by a boss molded into a cavity in a latch button and by a slot in a cantilevered member. The resilient springback of the flat spring backs up the resilience of the integral spring to provide long-term positive latching.

According to an embodiment of the invention, there is provided a latch member for a telescoping handle comprising: a latching dog, a latch button adapted for manual actuation, an integral hinge connecting the latching dog and the latch button, the latching dog, latch button and integral hinge being integrally formed of a plastic resin, a flat metallic spring, means in the latch button for abutting a first end of the flat metallic spring, means in the latching dog for abutting a second end of the flat metallic spring, the flat metallic spring being formed to require deformation thereof to fit the first and second ends to their respective abutting members, the deformation placing a resilient prestress on the flat metallic spring, and the resilient prestress being in a direction and having a force and a direction effective for urging rotation of the latching dog and the latch button about the integral hinge toward a latching position of the latching dog.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
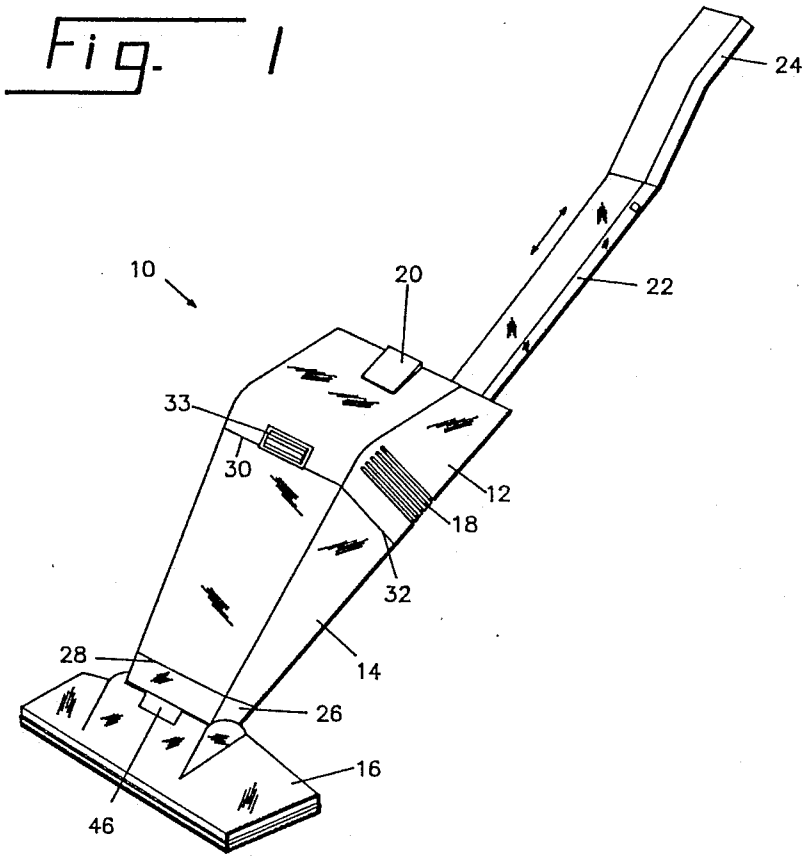
FIG. 1 is a perspective view of a vacuum cleaner according to an embodiment of the invention.

Referring to FIG. 1, there is shown, generally at 10, a vacuum cleaner according to an embodiment of the invention. A power unit 12, containing a conventional electric motor and fan (not shown) draws air through a dust bowl 14 operatively connected at its lower end to a swivelling floor tool 16. Air exits power unit 12 through a plurality of louvers 18 in power unit 12 after being filtered in a conventional filter element in dust bowl 14. An electric switch 20 controls the application of electric power to power unit 12.

Although the present invention is equally applicable to an externally powered and an internally (battery) powered embodiment, for concreteness, an internally powered embodiment of the invention is assumed. The electric motor and fan in power unit 12 and the filtering element in dust bowl 14 are conventional and are fully detailed in the referenced patent. Thus, further description thereof is omitted.

A telescoping shaft 22, supporting a handle 24 at an extremity thereof, supports and guides vacuum cleaner 10 with a lower surface of swivelling floor tool 16 in contact with a floor (not shown). As will be more fully detailed hereinafter, telescoping shaft 22 is provided with means for permitting it to telescope between a minimum to a maximum length whereby compactness for storage is provided as well as convenient length for use in cleaning a floor without stooping.

An interface 26, swivellably affixed to swivelling floor tool 16 receives and seals a forward end 28 of dust bowl 14. An upper end 30 of dust bowl 14 is held in face-to-face abutment with a lower face 32 of power unit 12. A dustbowl latch 33 ensures that, once dust bowl 14 is installed in the position shown, it remains in such position.

Figure 2:
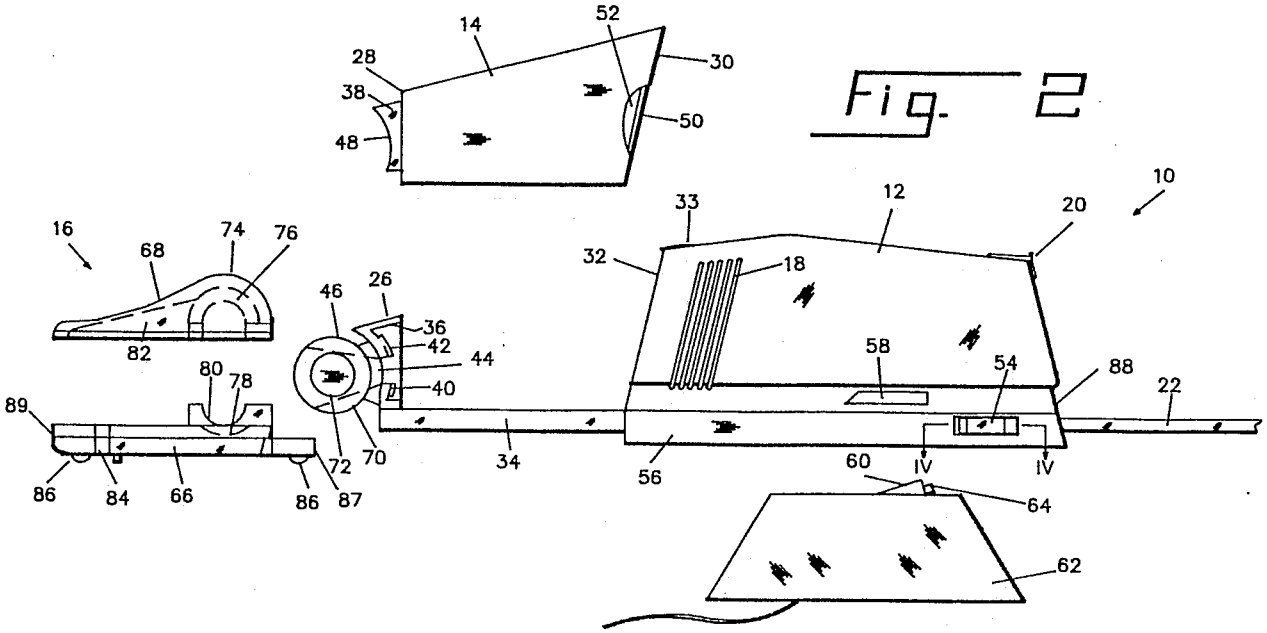
FIG. 2 is a side view of the vacuum cleaner of FIG. 1 with its dust bowl moved aside and its floor tool partly disassembled. A support assembly is also shown adjacent the vacuum cleaner.

Referring now to FIG. 2, wherein dust bowl 14 is displaced and swivelling floor tool 16 is partially disassembled for clarity of illustration, a frame 34 provides the principal support for all elements of vacuum cleaner 10. Interface 26 is seen to extend at right angles from frame 34. A socket 36 in interface 26 permits insertion of a mating part 38 extending forward from forward end 28. A curved surface 40 in socket 36 supports a sealing pad 42 surrounding an air duct 44 which passes into a generally cylindrical swivel member 46. A curved forward surface 48 on mating part 38 is shaped to seat in a sealing manner against sealing pad 42. It will be noted that upper end 30 and lower face 32 are disposed at equal angles with respect to a longitudinal axis of frame 34. A gasket 50 surrounding a filter element 52 in a downstream end of dust bowl 14 is moved into sealing engagement with lower face 32 to provide a closed sealing figure on lower face 32, whereby a sealed air path is created between power unit 12 and air duct 44.

A latch button 54, about which more will be discussed later, protrudes through a side of a channel 56 at the rear of power unit 12. A pair of support openings 58 (only one of which is shown, the other is disposed in a symmetrical location on the hidden side of power unit 12) provide means for entry of a mating pair of support horns 60 (only the nearer of which is shown) of a support assembly 62. Support assembly 62 may include means for positioning an electrical connector 64 enterable into support opening 58 for providing charging power to batteries internal to power unit 12. A connector assembly (not shown) within support opening 58 cooperates with electrical connector 64 to disconnect the internal motor in power unit 12 when vacuum cleaner 10 is mounted for support and charging on support assembly 62.

Swivelling floor tool 16 includes a floor plate 66 and a cover plate 68 mateable together to sealably encircle cylindrical swivel member 46. Cylindrical, swivel member 46 has an cylindrical surface 70 centrally disposed at each end thereof (only the outer cylindrical surface 70 at the near end of cover plate 68 is shown). Cover plate 68 includes a semi-cylindrical sealing surface 74 shaped to seal against an upper portion of outer cylindrical surface 70. A semi-circular guide 76 at each end of semi-cylindrical sealing surface 74 receives a respective cylindrical hub 72. A part-cylindrical sealing surface 78 on floor plate 66 is shaped to seal against a lower portion of outer cylindrical surface 70. A semi-circular guide 80 at each end of part-cylindrical sealing surface 78 forms, with its complementary semi-circular guide 76 on cover plate 68, a complete circle surrounding its respective cylindrical hub 72, thereby providing support and guidance thereof.

An air channel 82 in cover plate 68 extends forward from semi-cylindrical sealing surface 74 toward a front of cover plate 68. A vacuum port 84 in floor plate 66 is disposed below air channel 82. The perimeters of floor plate 66 and cover plate 68 are sealed to each other using any convenient means (not shown), whereby a complete sealed air path is provided between air duct 44 and vacuum port 84. The cylindrical shape of outer cylindrical surface 70, and the complementary shapes of semi-cylindrical sealing surface 74 and part-cylindrical sealing surface 78 permit swivelling floor tool 16 to swivel about an axis of cylindrical swivel member 46. The sealing angular extents of semi-cylindrical sealing surface 74 and part-cylindrical sealing surface 78 are great enough to provide an air seal over the maximum swivel angle permitted by mechanical limits.

A plurality of conventional rollers 86 may be disposed in a bottom surface of floor plate 66 to provide rolling support for vacuum cleaner 10. In addition, a brush, not shown, may be disposed in the bottom surface of floor plate 66 to aid in loosening dirt.

Frame 34 extends, unbroken, from interface 26 to an upper end 88. Telescoping shaft 22 is disposed to slide in and out of upper end 88. Thus, frame 34 provides the backbone, and provides mounting, for the entire vacuum cleaner 10.

Figure 3:
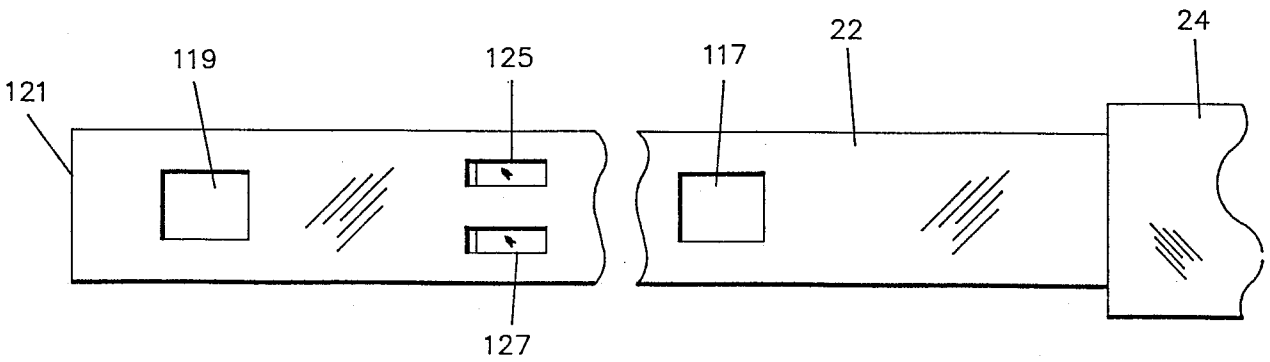
FIG. 3 ia a front view of the shaft of FIG. 2 removed from the remainder of the vacuum cleaner to show details thereof.

Referring now to FIG. 3, telescoping shaft 22 includes a locking nook 117 at an end nearer handle 24 and a similar locking nook 119 near an inner end 121 thereof. A pair of transversely spaced-apart limit ramps 125 and 127 are disposed on telescoping shaft 22 a predetermined distance away from locking nook 119.

Figure 4:
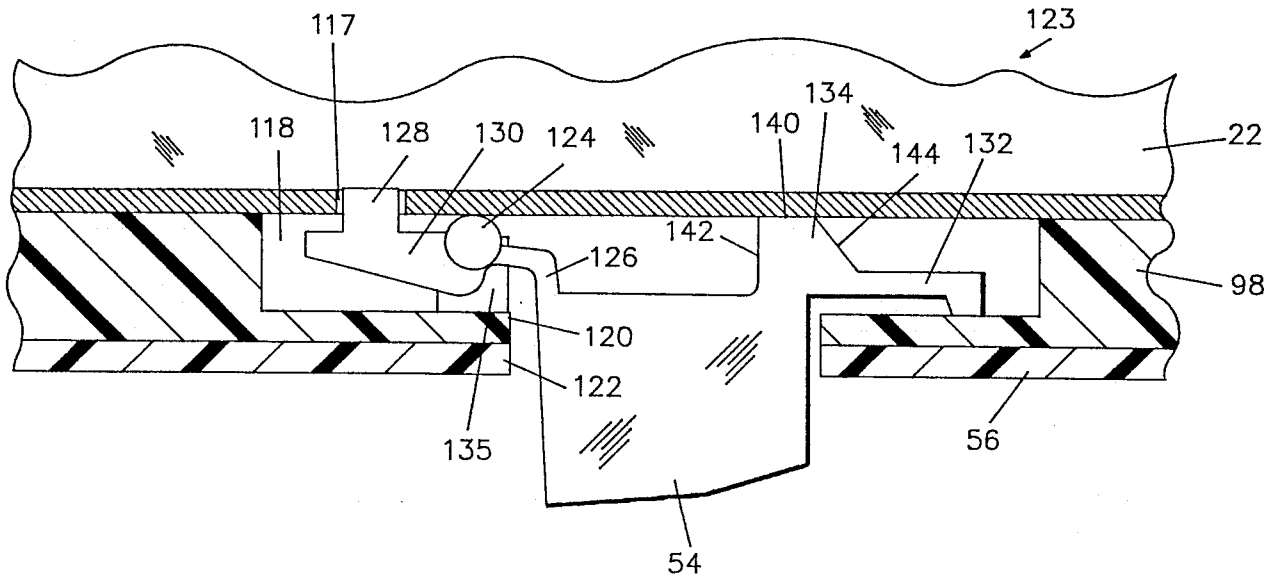
FIG. 4 is a cross section taken along IV—IV in FIG. 2 with the shaft in its extended and locked position.

Referring now to FIG. 4, telescoping shaft 22 is shown locked in its fully retracted position. A latch cavity 118 in frame half 98 surrounds an opening 120 in the frame half 98. An aligned opening 122 in channel 56 permits latch button 54, which forms part of a latch assembly 123, to pass therethrough to an outside position where it is accessible to a user. A pivot 124 is connected to latch button 54 by an integral hinge 126. A locking dog 128 is connected rigidly to pivot 124 by a lever arm 130. Limit plate 132 contacts a surface of latch cavity 118 remote from pivot 124 to limit a maximum amount by which latch button 54 is permitted to protrude through openings 120 and 122. A double ramp limit lock 134 adjacent an end of opening 120 remote from pivot 124, prevents withdrawing telescoping shaft 22 beyond a predetermined distance. Pivot 124 is supported near a surface of telescoping shaft 22 by a pair of fulcrums 135 (only the fulcrum 135 on the far side of latch assembly 123 is shown).

Locking dog 128 is urged through locking nook 117 by the resilient urging of integral hinge 126 to lock telescoping shaft 22 in its fully retracted position shown. In addition, bearing surface 140 is similarly urged into contact with the adjacent surface of telescoping shaft 22.

When latch button 54 is pressed inward, pivot 124, contacting the adjacent surface of telescoping shaft 22, rotates to permit outward motion of locking dog 128, whereby locking dog 128 is moved outward free of locking nook 117 against the resilient urging of integral hinge 126. In this condition, telescoping shaft 22 can be slid outward to an extended position.

Figure 5:
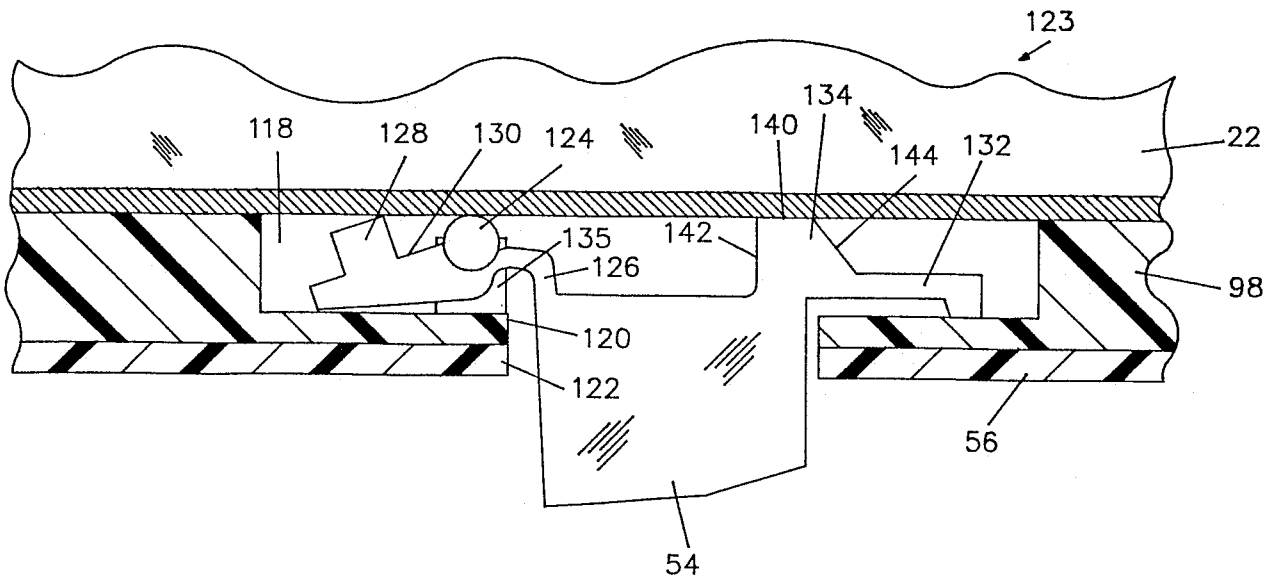
FIG. 5 is a cross section corresponding to FIG. 4 with the shaft in an intermediate position.

Referring now to FIG. 5, telescoping shaft 22 is shown in an intermediate, unlocked, position. Locking dog 128 and bearing surface 140 of double ramp limit lock 134 are urged into sliding contact with the adjacent surface of telescoping shaft 22 due to the support provided to pivots 124 by their respective fulcrums 135, and the resilience of integral hinge 126.

Figure 6:
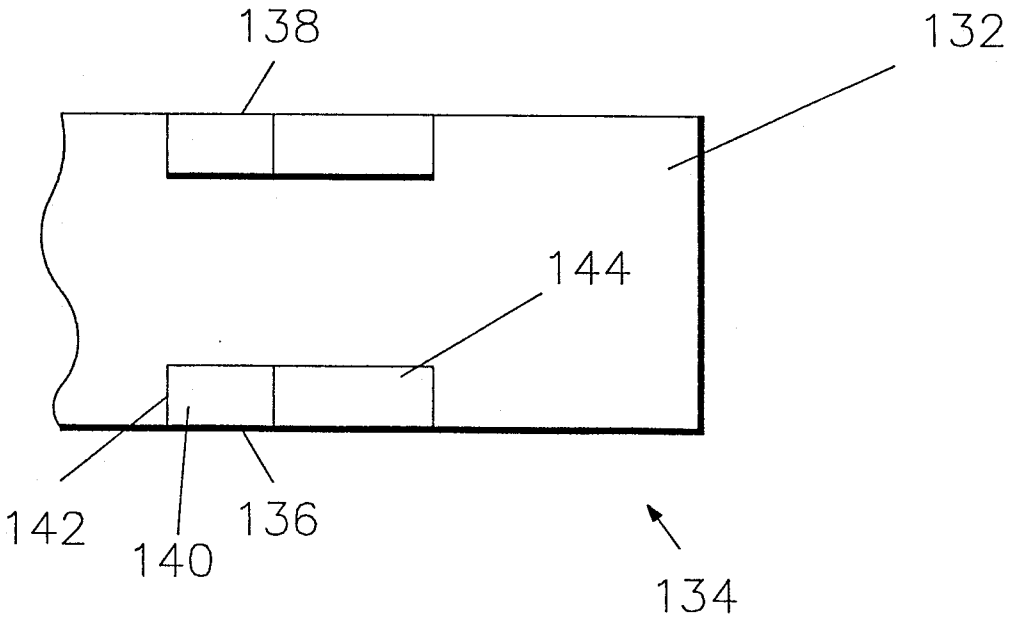
FIG. 6 is a close-up view of a limit plate from the latch button of FIGS. 4 and 5.

Referring to FIGS. 3 and 6, double ramp limit lock 134 includes first and second transversely spaced ramp teeth 136 and 138, each having a bearing surface 140, a locking abutment surface 142 and a sloping ramp surface 144. A center-to-center spacing of ramp teeth 136 and 138 is substantially equal to a center-to-center spacing of limit ramps 125 and 127 and a transverse dimension of each ramp tooth is such that it will fit into its respective limit ramp.

Figure 7:
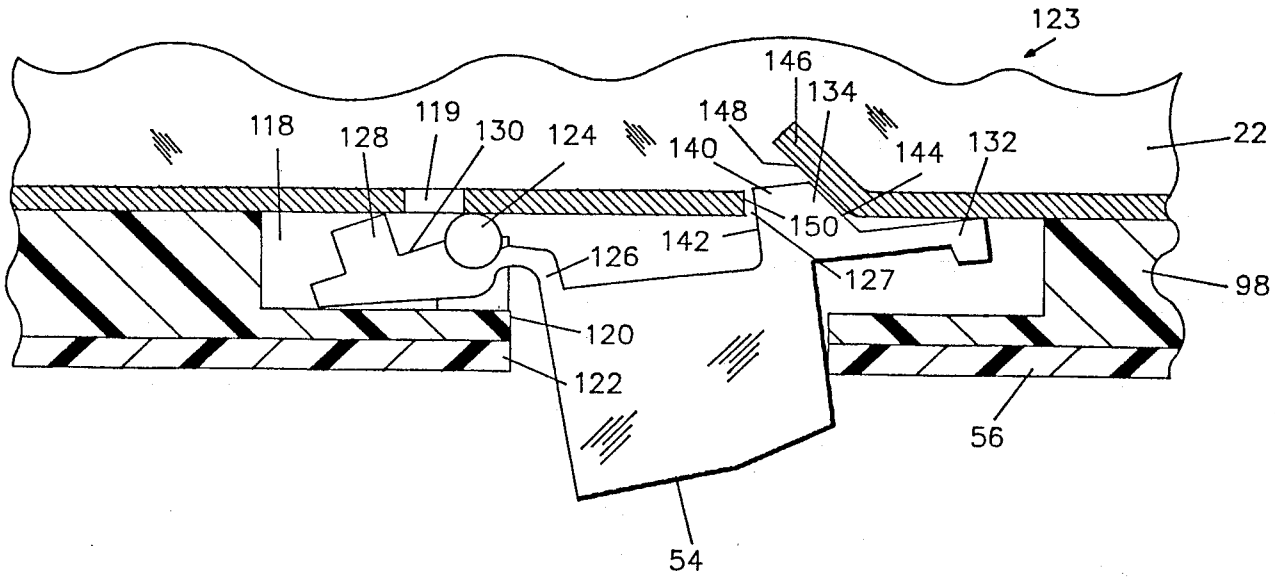
FIG. 7 is a cross section corresponding to FIGS. 4 and 5 with the shaft in its overextended and blocked position.

Referring now to FIG. 7, limit ramps 125 and 127 (only limit ramp 127 is shown) are formed by bending inward a tab 146 into the interior of telescoping shaft 22. Tab 146 provides an angled ramp surface 148 disposed at an angle substantially equal to an angle of ramp surface 144. A longitudinal spacing between locking nook 119 and limit ramps 125 and 127 is such that locking dog 128 may enter, and lock into locking nook 119 before ramp teeth 136 and 138 reach their respective limit ramps 125 and 127. Full extension of telescoping shaft 22 is achieved with such locking. If a user presses latch button 54 and attempts to extend telescoping shaft 22 beyond its full extension, the condition shown in FIG. 7 is reached wherein ramp teeth 136 and 138 enter their respective limit ramps 125 and 127. Locking abutment surfaces 142 on ramp teeth 136 and 138 abut ends 150 of their respective limit ramps 125 and 127 whereby further extension is blocked.

Cooperation between angled ramp surfaces 148 and ramp surfaces 144, however, permit telescoping shaft 22 to be moved toward its retracted position. After a short travel in the retracting direction, locking dog 128 is urged into locking nook 119, whereby telescoping shaft 22 becomes locked in its normal full extension.

It has been discovered that, integral hinge 126 tends, over time to take a set in the deformed condition shown in FIGS. 5 and 7. As a consequence, insufficient resilient urging is available to ensure latching, particularly in the extended position shown in FIG. 4.

Figure 8:
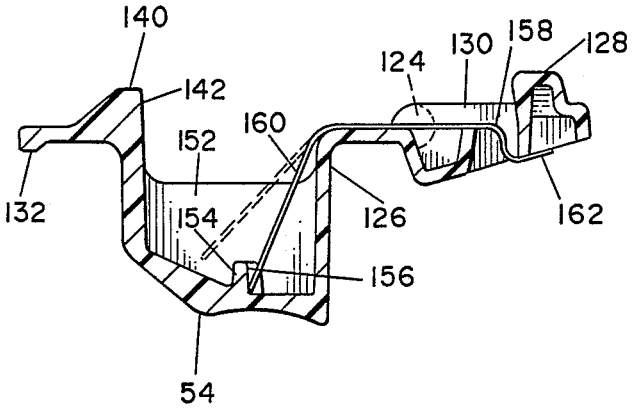
FIG. 8 is a cross section of the latch button, showing internal details thereof.

Referring now to FIG. 8, a cross section of latch button 54 reveals a hollow space 152. A boss 154 extends inwardly of the hollow space 152 to form an abutment wall 156 therein. A slot 158 in cantilevered member 130 receives a first end of a flat spring 160. An end 162 of flat spring 160 is turned to rest upon an upper end of locking dog 128. A second end of flat spring 160 is deformed from its unstressed condition (shown in dashed line) into a stressed condition (shown in solid line) against abutment wall 156. The prestress of flat spring 160, caused by deforming it into the solid-line condition shown, tends to urge rotation of locking dog 128 in a counterclockwise direction about integral hinge 126. Referring to prior figures in this disclosure, it will be found that this urging is in the direction required for locking handle 24 in a desired position.

Flat spring 160 may be of any suitable material capable of providing long-term resilience. For example, suitable types of stainless steel, spring steel, beryllium bronze and the like may be employed. The width and thickness of flat spring 160 depends on the material used, and on the amount of resilient urging in a particular application. One skilled in the art, with the present disclosure for reference would be fully instructed to enable selection of a proper material and dimensions for flat spring 160 without requiring any experimentation.

It has been discovered that the combination of integral hinge 126, backed up by the resilience of prestressed flat spring 160 solves the problem of loss of resilience in integral hinge 126 over the life of the apparatus. This result is attained at the very small cost of adding flat spring 160 and of the one-time cost of modifying molds to form boss 154 interiorly of larch button 54 and slot 158 in cantilevered member 130 to receive and retain flat spring 160.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A latch member for a telescoping handle comprising:

a latching dog;

a latch button adapted for manual actuation;

an integral hinge connecting said latching dog and said latch button;

said latching dog, latch button and integral hinge being integrally formed of a plastic resin;

a flat metallic spring;

means in said latch button for abutting a first end of said flat metallic spring;

means in said latching dog for abutting a second end of said flat metallic spring;

said flat metallic spring being formed to require deformation thereof to fit said first and second ends to their respective abutting members, said deformation placing a resilient prestress on said flat metallic spring; and said resilient prestress being in a direction and having a force and a direction effective for urging rotation of said latching dog and said latch button about said integral hinge toward a latching position of said latching dog.

2. A latch member according to claim 1 wherein said flat metal spring is stainless steel.

* * * * *